US012473803B2

(12) United States Patent
Prisbell et al.

(10) Patent No.: US 12,473,803 B2
(45) Date of Patent: Nov. 18, 2025

(54) INTELLIGENT SWITCHING IN DOWNHOLE TOOLS

(71) Applicant: Schlumberger Technology Corporation, Sugar Land, TX (US)

(72) Inventors: Andrew Prisbell, Sugar Land, TX (US); Todd Busch, Alvin, TX (US); Atsushi Nakano, Newcastle, WA (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/698,419

(22) PCT Filed: Dec. 20, 2022

(86) PCT No.: PCT/US2022/053438
§ 371 (c)(1),
(2) Date: Apr. 4, 2024

(87) PCT Pub. No.: WO2023/129415
PCT Pub. Date: Jul. 6, 2023

(65) Prior Publication Data

US 2024/0418060 A1 Dec. 19, 2024

Related U.S. Application Data

(60) Provisional application No. 63/266,123, filed on Dec. 29, 2021.

(51) Int. Cl.
*E21B 43/1185* (2006.01)
*E21B 43/117* (2006.01)
*E21B 47/04* (2012.01)

(52) U.S. Cl.
CPC ..... *E21B 43/1185* (2013.01); *E21B 43/117* (2013.01); *E21B 47/04* (2013.01)

(58) Field of Classification Search
CPC ..... E21B 43/117; E21B 43/1185
See application file for complete search history.

(56) References Cited

U.S. PATENT DOCUMENTS 4,234,768 A 11/1980 Boop
4,648,471 A * 3/1987 Bordon ..... E21B 43/11857 166/65.1

(Continued)

FOREIGN PATENT DOCUMENTS

WO 2021163656 A1 8/2021

OTHER PUBLICATIONS

Search Report and Written Opinion of International Patent Application No. PCT/US2022/053438 dated Apr. 26, 2023, 11 pages.

*Primary Examiner* — Jennifer H Gay
(74) *Attorney, Agent, or Firm* — Jeffrey D. Frantz

(57) ABSTRACT

A perforation tool is described herein. The perforation tool has a charge unit comprising a shaped charge; an initiator attached adjacent to the charge unit and comprising a detonator disposed to energize the shaped charge; and a switch attached adjacent to the charge unit and disposed to apply a voltage to the detonator, the switch comprising a processing unit configured to receive data representing depth, compare the received data to a depth target, and apply the voltage to the detonator if the received depth indicates the depth target has been reached. The processing unit can be configured to receive any data that can be converted to depth or any data that can represent an activation condition and apply the voltage when the data indicates the activation condition has been met. The processing unit can be programmed to initiate and operate autonomously in a well independent of surface signals.

14 Claims, 3 Drawing Sheets

(56) References Cited

U.S. PATENT DOCUMENTS

| | | | | |
|---|---|---|---|---|
| 4,778,009 | A | 10/1988 | Sumner | |
| 5,343,963 | A * | 9/1994 | Bouldin | E21B 34/102 175/38 |
| 5,369,579 | A * | 11/1994 | Anderson | F42D 1/04 175/4.54 |
| 7,902,469 | B2 | 3/2011 | Hurst | |
| 8,387,533 | B2 | 3/2013 | Runkel | |
| 10,794,159 | B2 * | 10/2020 | Eitschberger | E21B 23/10 |
| 11,591,885 | B2 * | 2/2023 | Eitschberger | E21B 43/1185 |
| 11,661,824 | B2 * | 5/2023 | Eitschberger | E21B 33/068 175/4.55 |
| 12,031,417 | B2 * | 7/2024 | Eitschberger | E21B 43/117 |
| 2011/0090091 | A1 * | 4/2011 | Lerche | E21B 41/0021 340/853.2 |
| 2012/0006217 | A1 * | 1/2012 | Anderson | F42D 3/04 102/215 |
| 2012/0247771 | A1 | 10/2012 | Black | |
| 2014/0000877 | A1 * | 1/2014 | Robertson | E21B 43/1185 166/250.15 |
| 2015/0096752 | A1 | 4/2015 | Burgos | |
| 2019/0309608 | A1 * | 10/2019 | Phelps | F42D 1/05 |
| 2019/0368321 | A1 * | 12/2019 | Eitschberger | E21B 23/10 |
| 2020/0018139 | A1 * | 1/2020 | Eitschberger | E21B 43/1185 |
| 2021/0198983 | A1 * | 7/2021 | Eitschberger | E21B 43/117 |
| 2022/0333467 | A1 * | 10/2022 | Eitschberger | E21B 33/068 |
| 2023/0106595 | A1 * | 4/2023 | Eitschberger | E21B 43/1185 166/297 |
| 2024/0418060 | A1 * | 12/2024 | Prisbell | E21B 47/04 |
| 2025/0020046 | A1 * | 1/2025 | Zakharia | E21B 43/1185 |

* cited by examiner

INTELLIGENT SWITCHING IN DOWNHOLE TOOLS

CROSS-REFERENCE TO RELATED APPLICATIONS

This application is a National Stage Entry of International Application No. PCT/US2022/053438, filed Dec. 20, 2022, which claims the benefit of U.S. Provisional Application No. 63/266,123 entitled "Intelligent Switching in Downhole Tools," filed Dec. 29, 2021, the disclosure of which is incorporated by reference herein in its entirety.

BACKGROUND

Embodiments herein generally relate to formation perforation tools used in oil and gas production. Specifically, the embodiments herein relate to autonomous switching for perforation tools.

DESCRIPTION OF THE RELATED ART

Perforation tools are tools used in oil and gas production to form holes, passages, and/or fractures in hydrocarbon-bearing geologic formations, and/or casings deployed into such formations, to promote flow of hydrocarbons from the formation into the well for production. The tools generally have explosive charges shaped to project a jet of reaction products, including hot gases and molten metal, into the formation. The tool has a generally tubular profile, and includes support frames, ignition circuits, and wiring for activating the charges and communicating signals and/or data along the tool. The charges are activated by initiators, which are in turn activated by switch mechanisms that supply electric power to a detonation unit within the initiator. A separate arming circuit is typically employed to prevent unwanted discharge of explosives. The arming circuit may be activated by signals from a surface unit, by pressure waves within the hole, and by input from a sensor, such as a depth sensor. Multiple perforation tools may be attached to one downhole string, each equipped with a firing switch and an arming circuit. In one example, the firing switch for each tool includes a microprocessor that is digitally addressable from a surface unit to select specific tools for firing.

It is typically desired to activate perforation tools on a string in a specific pattern or according to specific timing or conditions. Accurate acquisition of the conditions for firing a specific tool are often challenging in the downhole environment. Conventionally, firing of perforation tools downhole is initiated by signals from the surface. Signaling from the surface also introduces delays that complicate accurate activation. Thus, there is a need for improved methods and apparatus for activating downhole tools.

SUMMARY

Embodiments described herein provide a perforation tool, comprising a charge unit comprising a shaped charge; an initiator attached adjacent to the charge unit and comprising a detonator disposed to energize the shaped charge; and a switch attached adjacent to the charge unit and disposed to apply a voltage to the detonator, the switch comprising a processing unit configured to receive data representing depth, compare the received data to a depth target, and apply the voltage to the detonator if the received depth indicates the depth target has been reached.

Other embodiments described herein provide a method of operating a downhole tool, the method comprising providing an electronic switch as a part of the downhole tool to activate the downhole tool, the electronic switch comprising a processing unit configured to receive first data representing an environmental condition or operating configuration, compare the first data to second data representing conditions under which to activate the downhole tool, and activate the downhole tool based on the comparison; lowering the downhole tool into a well; storing the second data in a memory unit of the electronic switch while the downhole tool is in the well; storing a tool routine in the memory unit of the electronic switch while the downhole tool is in the well, the tool routine comprising instructions for the processing unit to receive the first data, perform the comparison of the first data with the second data, and activate the tool based on the comparison; and causing the processing unit to execute the tool routine while the downhole tool is in the well.

Other embodiments described herein provide a perforation tool, comprising a charge unit comprising a shaped charge; a sensor module to sense at least one environmental condition and at least one operating condition; a power source; an initiator attached adjacent to the charge unit and comprising a detonator disposed to energize the shaped charge; and a switch attached adjacent to the charge unit and disposed to apply a voltage from the power source to the detonator, the switch comprising a processing unit configured to receive first data representing the at least one environmental condition and the at least one operating condition from the sensor module; receive second data representing an activation condition from a surface unit; compare the first data to the second data and determine whether to activate the detonator based on the comparison, and apply the voltage to the detonator if the comparison indicates an activation condition has been reached.

Various embodiments of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only exemplary embodiments and are therefore not to be considered limiting of its scope, may admit to other equally effective embodiments.

DETAILED DESCRIPTION

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The perforation tools, and methods, described herein use electronic switching with an autonomous component for activating explosive charges. Such switches can also be used with downhole tools other than perforation tools, where electronic activation of the tool is to be applied downhole depending on an environmental condition and/or operating configuration. The electronic switch has a processing unit configured to receive data and determine when an activation condition is met. The processing unit is further configured to cause a switch to switch voltage to an electronic interface to activate the tool. The processing unit can be programmed to operate the switch when the activation condition is met. The programming can be downloaded to the electronic switch to a memory unit of the electronic switch using a communication unit of the electronic switch, or coupled to the electronic switch. The programming includes instructions that, when executed by the processing unit, cause the electronic switch to receive data representing the environmental condition and/or operating configuration, compare the received data to data representing when the activation condition occurs, to determine when the activation condition is met, and to operate the switch when the activation condition is met.

Figure 1:
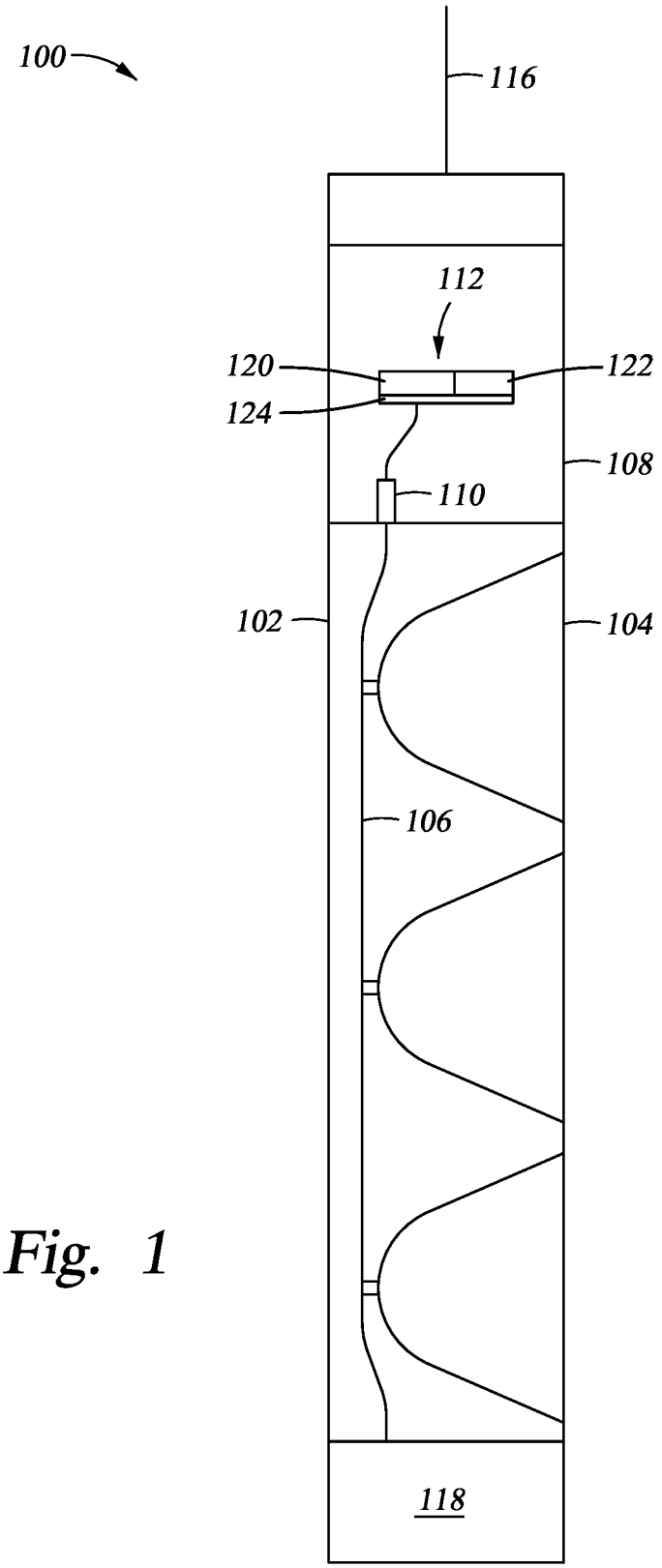
FIG. 1 is a schematic diagram of a perforation tool according to one embodiment.

FIG. 1 is a schematic view of a perforation tool 100 according to one embodiment. The perforation tool 100 has a charge unit 102 that houses one or more shaped charges 104 for directing high energy material into a subterranean formation, optionally through a well casing, when initiated within a well. The charges 104 have explosive material that detonates to form the high energy material. Detonation of the charges 104 may be triggered by use of a ballistic transfer device 106, which may be a detonation cord or a conduit for ballistic transfer. The perforation tool 100 has an initiator 108 that initiates an energy discharge to activate the charges 104. The initiator 108 typically has a detonator 110 that activates ballistic transfer through the ballistic transfer device 106. The detonator 110 is typically activated by an electronic switch 112. The perforation tool 100 typically includes, or is associated with, one or more sensors (e.g., sensor 318, in FIG. 3) which may be arranged in a sensor module. The sensor module may be adjacent to the initiator 108, or may be spaced apart from the initiator 108, the charge unit 102 and other components of the perforation tool 100. Multiple perforation tools 100 are commonly strung together on a wire line 116, so each perforation tool 100 may include a shield 118 deployed between the charge unit 102 of one perforation tool 100 and the initiator 108 of the next perforation tool 100 to shield the electronics of the initiator 108 from ballistic discharge of an adjacent charge unit 102. Here, only one perforation tool 100 is shown for simplicity.

Conventionally, the switch 112 is configured to receive signals and power from the surface along the wire line 116. Here, the switch 112 is coupled to, or includes, a local power supply 120, such as a battery unit or capacitor. The switch 112 is also coupled to, or includes, a communication unit 122, which may be a wireless communication unit. Configured with the local power supply 120 and a wireless version of the communication unit 122, the switch 112 is configured to operate independent of any wire line communication. Where the communication unit 122 is not wireless, the communication unit 122 can provide communication between the switch 112 and surface equipment along the wire line 116. The communication unit 122 can also provide communication between the switch 112 and sensors, other than those in the sensor module, deployed along the wire line 116. The communication unit 122 can also provide communication between the switch 112 and electronic switches of other perforation tools.

The switch 112 has an activation unit that is capable of determining, autonomously, when to activate the detonator 110. The activation unit includes a programmable digital processing unit 124 to compute whether to apply a voltage to the detonator 110 to initiate the ballistic discharge. The activation unit is powered by the local power supply 120 and communicates using the communication unit 122. Each perforation tool 100 in a string of such tools can have a switch like the switch 112, and all the switches 112 can form a communication network, optionally including surface equipment, such that all the perforation tools 100 in a string can communicate.

The switch 112 is attached adjacent to the charge unit 102 so that the switch 112 goes downhole with the rest of the perforation tool 100. While downhole, the switch 112 can repeatedly receive data from sensors, for example sensors of the sensor module, for analysis to determine whether an activation condition has been reached. For example, the sensor module can have a sensor that senses an environmental condition such as temperature, pressure, density, radiation, electrical conductivity, gravity, turbidity, or any other environmental condition. Either the sensor module or the digital processing unit of the switch 112 can be configured to resolve depth from a reading of the sensor module, for example by applying a correlation of the environmental condition with depth. For example, the sensor module or the switch 112 can be configured to store a correlation of pressure with depth, or radiation with depth, and to apply the correlation to a sensor reading of pressure or radiation, or any other environmental condition that can be correlated with depth. This application of a depth correlation to a sensor reading can take place autonomously downhole. Where the sensor module is configured to resolve depth using a correlation to an environmental condition, the processing unit can be configured to receive data representing depth from the sensor module, or from another source.

The processing unit of the switch 112 can be further configured to compare the correlated depth with a depth target to determine, autonomously while downhole, whether an activation condition for the perforation tool 100 has been reached. The switch 112 can be further configured to apply voltage from the power supply 118 to the detonator 110 to initiate ballistic discharge. It should be noted that the correlated depth can be derived from the signals of more than one sensor. For example, sensor readings representing more than one environmental condition can be correlated to depth in order to improve the estimate of depth, and the depth resolved from more than one sensor reading can be used by the processing unit to determine whether to activate the perforation tool.

Figure 2:
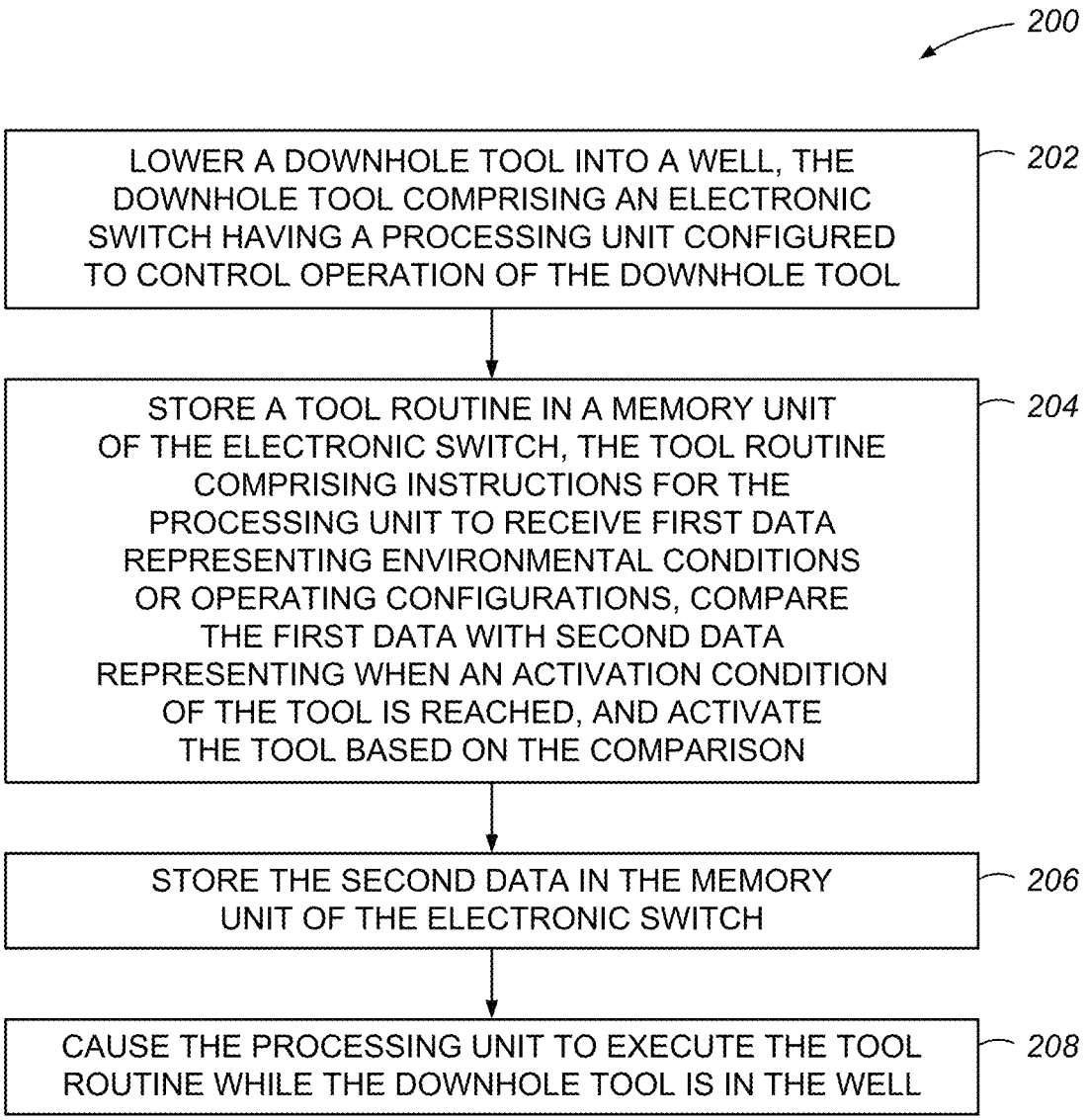
FIG. 2 is a flow diagram summarizing a method according to one embodiment.

FIG. 2 is a flow diagram summarizing a method 200 according to one embodiment. The method 200 is a method of operating a downhole tool activated by an intelligent electronic switch like the switches described elsewhere herein. The method includes, at 202, lowering a downhole tool into a well, the downhole tool comprising an electronic switch having a processing unit configured to control operation of the downhole tool.

The processing unit is a digital processing unit that is programmable and configurable, either at the surface or downhole. Programming, configuration data, and sensor data can be communicated to the electronic switch under control of the processing unit using the communication unit, either at the surface or downhole. The electronic switch includes, or is coupled to, a power source that is operable downhole to power the processing unit, the communication unit, the memory unit, and system hardware for interoperation of the units, and also to apply voltage to any functional devices of the downhole tool, such as an initiation module with a detonator in the case of a perforation tool. The electronic switch or the processing unit can use, or include, a communication unit to send and receive data.

At 204, a tool routine is stored in the memory unit of the tool, which can be a memory unit of the electronic switch. The tool routine comprises instructions that, when executed by the processing unit, cause the tool to receive, and optionally store, first data representing environmental conditions or operating configurations, or both, optionally receive and store second data representing when an activation condition of the tool is reached, compare the first data to the second data, and activate the tool based on the comparison.

The tool routine may include activation decision instructions, data collection instructions, data reporting instructions, mode change instructions, and configuration update instructions. The electronic switch is configured such that the processing unit executes the tool routine while the tool is downhole. The tool routine can be initiated at the surface and continue execution as the downhole tool is lowered into the well, or the tool routine can be initiated downhole by sending a command to the processing unit of the electronic switch using the communication unit. Alternately, the tool routine can be initiated when a depth target is reached, for example where the processing unit is configured to execute a startup routine that initiates execution of the tool routine when the depth target is reached.

The tool routine for a perforation tool may include instructions that cause the downhole switch for the tool to repeatedly, optionally periodically or otherwise triggered by a detected event, receive data from a surface winch controller, compute tool depth from the winch controller data, and compare tool depth to a target depth, determine when the tool has reached an activation depth, and apply voltage to a detonator to initiate ballistic discharge. The tool routine may include instructions that cause the downhole switch to repeatedly, optionally periodically or otherwise triggered by a detected event, receive data from a pressure sensor, correlate the data using a well log stored in a memory of the electronic switch, resolve a tool depth using the pressure data correlated with the well log data, potentially compare the resolved tool depth to a tool depth computed from winch controller data received by the switch, determine a high-confidence tool depth, compare the high-confidence tool depth to a target depth, determine when the tool has reached an activation depth, and apply voltage to a detonator to initiate ballistic discharge.

The first data may be received from, or may originate a signals from, sensors, downhole tools, and surface equipment, which may be arranged in a sensor module that communicates with the electronic switch using the communication unit. Signals from various equipment may represent environmental conditions such as temperature, pressure, electrical conductivity (or other electrical conditions such as capacitance or impedance), radiation, turbidity, density, gravity, and the like. Alternately or additionally, the signals may represent operating configurations such as status of one or more downhole tools, operating signals, arming status, program stage, tool movement speed, tool orientation, depth, wire line tension, faults, and the like. The signals may be converted to data at the source, that is, by the sensor or equipment originating the signal or by the sensor module, or the processing unit may be configured to convert the signals into data. The first data may also represent trends in readings from sensors and/or equipment. In one example, the sensor module is configured to resolve a tool depth based on sensing an environmental condition and to provide the tool depth as part of the first data.

At 206, the second data is stored in the memory unit of the electronic switch. The second data may be a single parameter, such as depth, or a collection of parameters that can be any combination of environmental conditions and operational configurations or parameters. For example, the activation condition might be a combination of a depth target and a successful arming process, or a combination of a depth target and an orientation target. The second data is stored in a memory unit of the electronic switch for use in determining whether to activate the tool. The second data may be stored in the memory unit while the downhole tool is at the surface, or the second data may be communicated to the memory unit after the downhole tool is lowered into the well, or while the downhole tool is being lowered into the well. For example, a winch can begin lowering the downhole tool to a staging depth while the second data is being communicated to the memory unit. The tool routine can also be communicated to the memory unit during initial staging.

At 208, the processing unit is caused to execute the tool routine while the downhole tool is in the well. In one case, the processing unit of the electronic switch compares the first data to the second data while the tool is downhole. The processing unit reads the second data from the memory unit, and optionally reads the first data from the memory unit to perform the comparison. The processing unit repeatedly performs the comparison using updates of the first data received from the sensors and other equipment.

Based on the comparison, the processing unit activates the tool when the comparison indicates an activation condition has been reached. In that circumstance, the processing unit controls a circuit switch that is part of the electronic switch, while the tool is downhole, to apply voltage from a power source to activate the tool. Where the downhole tool is a perforation tool, or any tool that uses an ignition source as part of an initiation module, the processing unit applies voltage from the power source to an initiator, which may include a detonator. The method 200 can be used to make the downhole tool largely autonomous and independent of surface signals.

Figure 3:
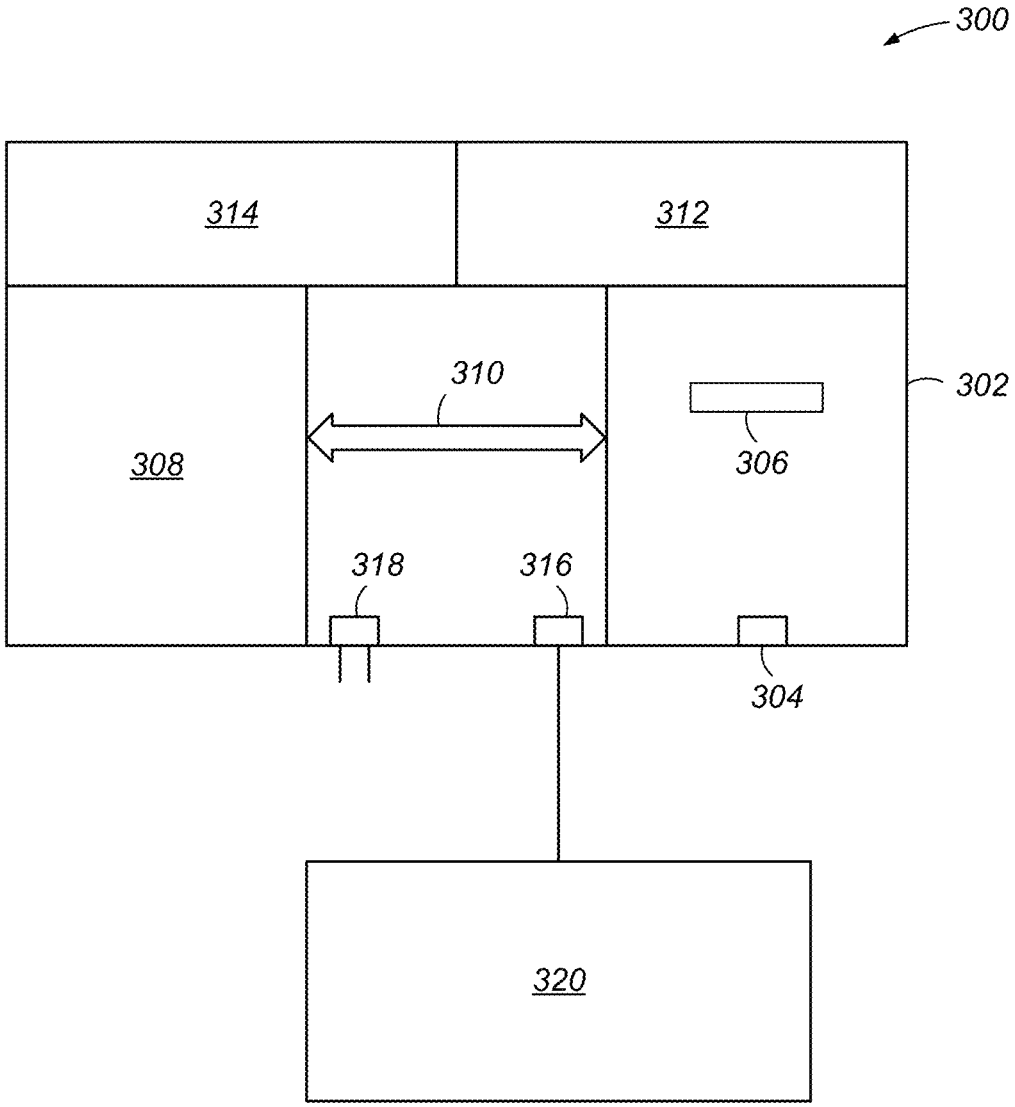
FIG. 3 is a functional diagram of an electronic switch according to one embodiment To facilitate understanding, identical reference numerals have been used, where possible, to designate identical elements that are common to the figures. It is contemplated that elements and features of one embodiment may be beneficially incorporated in other embodiments without further recitation.

FIG. 3 is a configuration diagram of an intelligent switch 300, according to one embodiment. The switch 300 can be used as the switch 112 in the perforation tool 100 of FIG. 1. The switch 300 also can be used as part of a downhole tool to perform the method 200. The switch 300 has a processing unit 302 configured as an activation unit, with an electrical interface 304 that can electrically couple a voltage from a power source to an initiation component or module of a tool to initiate operation of the tool. For example, the electrical interface 304 can be used to electrically couple a voltage from a power source to a detonator to apply voltage to the detonator to initiate a ballistic discharge. The processing unit 302 is a digital processing unit that includes a microprocessor 306. The processing unit 302 may include other processing structures or architectures such as field-programmable gate arrays (FPGAs), graphics processing units (GPUs), or specialized digital signal processing (DSP) units. The processing unit 302 may include PCIe communication between the various processing structures described above.

The switch 300 has a digital memory 308 that interfaces with and/or communicates with the processing unit 302 via a data bus 310. The digital memory 308 can be used to store program instructions for execution by the processing unit 302, configuration data for any of the components of the switch 300, configuration data for any or all downhole tools that use a switch like the switch 300, sensor data for use by the processing unit 302, and operating configuration data for components of the switch or for the downhole tool, or tools, that use the switch. The digital memory 308 can include any type of RAM or ROM memory.

The switch 300 also has a communication unit 312, which may be wireless and/or wired to a wire line. Note that the communication unit could also be separate from the switch 300 but accessible by the switch 300 for input and output communication. The communication unit 312 may be configured to use any convenient communication protocol, and may be configured for automated networking with other communication units at the surface or downhole. The communication unit 312 can be configured to receive, from a sensor module, signals representing environmental conditions and/or operating configurations. The environmental conditions may include temperature, pressure, composition, electrical conductivity, radiation, and other similar environmental conditions. The operating configurations may include depth, movement speed, wire line tension, tool orientation, arming status, status of other downhole tools, activation modes, and other configuration signals.

The processing unit 306 is programmable using any convenient programming protocol. The processing unit 306 may be programmed while the unit is at the surface, prior to being deployed downhole, or the processing unit 306 may be programmed, or re-programmed, while downhole using the communication unit 312. Centrally, the processing unit 306 is programmable to process data originating from signals of sensors and to determine, based on the data, whether an optimal time has been reached to activate the detonator of a perforation tool. The processing unit 306 may be programmed to resolve any or all of tool depth, tool movement time, tool movement speed, tool orientation, tool rotation speed, tool arming status, perforation program stage, status of other perforating tools, tool firing faults, well pressure and temperature, configuration signals and modes, and any comparison of such data to target values. The processing unit 306 may be programmed to output data, using the communication unit 312, to surface equipment and other tools, including other perforation tools, in a tool string.

The processing unit 306 may be programmed to receive operating instructions from surface equipment and to change operating modes based on such instructions. For example, the processing unit 306 may be programmed to receive a "start" signal from surface equipment, and in response to the "start" signal to execute a perforation program. The processing unit 306 may be programmed to send control signals, using the communication unit 312, to surface equipment to change operating conditions or configurations of the downhole tool by adjusting operation of surface equipment such as winches and pumps. The processing unit 306 may be programmed to periodically output a data word that includes data used by the processing unit 306 to determine actions by the processing unit 306. For example, the processing unit 306 may be programmed to periodically broadcast, over a network, using the communication unit 312, a data word comprising the first data and/or the second data of the method 200. The processing unit 306 may be programmed to receive data words broadcast by other downhole tools.

The switch 300 can include, or be coupled to, a power source 314, which may travel downhole with the switch 300 or may be located at the surface. Here, the power source 314 is a member of the switch 300. The power source 314 may be a battery, or a plurality of batteries, or the power source 314 may be a capacitor of any suitable type. The power source 314 may carry power to operate the components of the switch 300, and may additionally carry power to operate and/or initiate any components of the downhole tool of which the switch 300 is a member. For example, the power source 314 may be a capacitor that is charged at the surface, or downhole, to provide voltage to initiate an operation of the downhole tool, such as an initiator of a perforation tool.

The switch 300 can include an electronic sensor 316 that is coupled to another downhole tool 320 to sense activation of the other downhole tool. The electronic sensor may be an electronic circuit that runs from the switch 300 to an adjacent downhole tool 320 to provide a signal to the processing unit of the switch indicating whether the adjacent tool has been activated. For example, a wire may be electrically connected from the switch 300 to an adjacent downhole tool in a way that activation of the downhole tool completes or breaks the circuit. The processing unit of the switch 300 can be configured to detect conductivity of the circuit to determine status of the adjacent tool. The switch 300 can also include a circuit for analog reporting of activity within the switch 300 to another intelligent switch of another downhole tool. In such cases, the processing unit of the switch 300 can be configured to arm a perforation tool upon detecting activation of an adjacent perforation tool, for example if the ballistic discharge of the adjacent perforation tool breaks the sensor circuit.

The intelligent switches described herein can be used to perform a vast array of functions downhole to facilitate operation of downhole tools. In addition to the functions described above, the processing unit of such an intelligent switch can be programmed to screen data used to determine whether to activate a downhole tool. The memory unit accessible by the processing unit can store data and instructions for the processing unit to model any aspect of operation to determine whether to activate the downhole tool. The processing unit can be programmed to perform expert analysis, for example using machine learning techniques, to identify when target conditions for activating the downhole tool are present. For example, if the downhole tool is to be initiated at a target depth, the processing unit can use any analytical technique to determine a confidence level for a depth reading of any type. If the depth reading has low confidence, the processing unit can obtain other data indicating depth to improve the confidence of the depth reading in order to improve accuracy of tool activation.

The intelligent switches described herein can be used to control, or to inform control of, the entire tool apparatus from the surface down. The switch, from on board the downhole tool, while in the well, can communicate data to surface equipment that alters operation of the surface equipment. For example, the intelligent switch can communicate a set point to any surface equipment, such as pumps, winches, and the like, to control the equipment directly or to a surface controller that controls the equipment. Intelligent switches deployed with a plurality of downhole tools can be configured in a network, and can be arranged in master-slave relationships where such functionality is useful.

The intelligent switches described herein can be configured to report data obtained downhole, report model results resolved downhole, obtain updated modeling data, configuration data, and programming based on conditions resolved autonomously by the switch while downhole, so that the switch can accurately determine activation conditions while downhole. Where switches are arranged in a master-slave relationship, a master switch can be configured to collect data from slave switches, report data for all switches to the surface, obtain modelling data, configuration data, and programming for all slave switches, and distribute the obtained data and programming to the slave switches, where such functionality is convenient. The communication and processing capabilities of an intelligent switch, as described herein, can also be used as edge processing for an internet-enabled downhole tool.

While the foregoing is directed to embodiments of the present invention, other and further embodiments of the present disclosure may be devised without departing from the basic scope thereof, and the scope thereof is determined by the claims that follow.

What is claimed is:

1. A perforation tool for use downhole in a well, comprising:

a charge unit comprising a shaped charge;

an initiator attached adjacent to the charge unit and comprising a detonator disposed to energize the shaped charge; and a switch attached adjacent to the charge unit and disposed to apply a voltage to the detonator, the switch comprising:

a processing unit;

memory coupled with the processing unit; and a communication unit, wherein the switch is configured to:

receive, via the communication unit and while downhole in the well, a tool routine, wherein the tool routine includes instructions programmable at the processing unit to cause the switch to apply the voltage to the detonator;

download, via the communication unit, the tool routine to store in the memory;

re-program, via the communication unit and while downhole in the well, the processing unit with the tool routine;

receive first sensor data from a first sensor, the first sensor data representative of a first environmental condition sensed by the first sensor;

resolve a tool depth using the first sensor data;

determine a confidence level for the tool depth;

responsive to the confidence level being lower than a threshold, receive second sensor data from a second sensor representative of a second environmental condition sensed by the second sensor;

resolve the tool depth using the second sensor data and the first sensor data;

responsive to the confidence level improving to greater than the threshold using the first sensor data and the second sensor data, compare, using the tool routine re-programmed into the processing unit, the tool depth to a depth target; and apply the voltage to the detonator if the comparison indicates the depth target has been reached.

2. The perforation tool of claim 1, wherein the switch further comprises an electronic sensor coupled to an adjacent tool.

3. The perforation tool of claim 2, wherein the processing unit is further configured to arm the initiator when the electronic sensor detects activation of the adjacent tool.

4. The perforation tool of claim 1, further comprising an electronic circuit coupled to an electronic sensor of an adjacent tool.

5. The perforation tool of claim 1, wherein the processing unit is further configured to store the tool routine in the memory unit.

6. A method of operating a downhole tool, the method comprising:

lowering the downhole tool into a well, the downhole tool comprising an electronic switch having a processing unit configured to control operation of the downhole tool;

receiving, via a communication unit at the electronic switch and while downhole in the well, a tool routine and storing the tool routine in a memory unit of the electronic switch after the downhole tool has been lowered into the well, wherein the tool routine includes instructions programmable at the processing unit to cause the electronic switch to apply the voltage to a detonator; and re-programming, via the communication unit and while the downhole tool is in the well, the processing unit with the tool routine, the re-programming causing the processing unit to:

receive first sensor data representing environmental conditions or operating configurations;

resolve a tool depth using the first sensor data;

determine a confidence level for the tool depth;

responsive to the confidence level being lower than a threshold, receive second sensor data from a second sensor representative of a second environmental condition sensed by the second sensor;

resolve the tool depth using the second sensor data and the first sensor data;

responsive to the confidence level improving to greater than the threshold using the first sensor data and the second sensor data, compare the tool depth with activation data representing when an activation condition of the downhole tool is reached, the activation data being communicated to the downhole tool after the downhole tool has been lowered into the well; and activate the downhole tool based on the comparison;

storing the activation data in the memory unit of the electronic switch; and causing the processing unit to execute the tool routine while the downhole tool is in the well.

7. The method of claim 6, further comprising disposing a sensor module in communication with the electronic switch to provide the first sensor data.

8. The method of claim 6, wherein the activation data includes a depth target and the processing unit is configured to execute the tool routine when the depth target is reached.

9. The method of claim 6, wherein the electronic switch further comprises an electronic sensor coupled to an adjacent tool to sense activation of the adjacent tool, and wherein the processing unit is configured to set the downhole tool to a ready state when the electronic sensor senses activation of the adjacent tool.

10. A perforation tool for use downhole in a well, comprising:

a charge unit comprising a shaped charge;

a sensor module configured to sense at least one environmental condition and at least one operating condition;

a power source;

an initiator attached adjacent to the charge unit and comprising a detonator disposed to energize the shaped charge; and a switch attached adjacent to the charge unit and disposed to apply a voltage from the power source to the detonator, the switch comprising:

a processing unit;

memory coupled with the processing unit; and a communication unit, wherein the switch is configured to:

receive, via the communication unit and while downhole in the well, a tool routine, wherein the tool routine includes instructions programmable at the processing unit to cause the processing unit to apply the voltage to the detonator;

download, via the communication unit, the tool routine to store in the memory;

re-program, via the communication unit and while downhole in the well, the processing unit with the tool routine;

receive first sensor data representing the at least one environmental condition and the at least one operating condition from the sensor module;

resolve a tool depth using the first sensor data;

determine a confidence level for the tool depth;

responsive to the confidence level being lower than a threshold, receive second sensor data from a second sensor representative of a second environmental condition sensed by the second sensor;

resolve the tool depth using the second sensor data and the first sensor data;

responsive to the confidence level improving to greater than the threshold using the first sensor data and the second sensor data, compare, using the tool routine re-programmed into the processing unit, the tool depth to an activation depth and determine whether to activate the detonator based on the comparison, and apply the voltage to the detonator if the comparison indicates an activation condition has been reached.

11. The perforation tool of claim 10, wherein the first sensor data includes one or more of a pressure, a temperature, a density, a radiation, and a gravity.

12. The perforation tool of claim 11, wherein the processing unit is configured to determine the tool depth based on a correlation stored in the memory.

13. The perforation tool of claim 10, wherein the processing unit is configured to obtain the activation depth from the memory after the received activation depth has been stored in the memory.

14. The perforation tool of claim 10, further comprising an electronic sensor coupled to an adjacent tool, wherein the processing unit is further configured to arm the initiator based on a signal from the electronic sensor.

* * * * *